United States Patent [19]

Kim

[11] Patent Number: 4,907,747

[45] Date of Patent: Mar. 13, 1990

[54] SANITARY CHEMICAL SPRAY APPARATUS

[76] Inventor: Il Yoo Kim, 7953 Audubon Ave. B-7, Alexandria, Va. 22306

[21] Appl. No.: 257,879

[22] Filed: Oct. 14, 1988

[51] Int. Cl.[4] ..... B05B 15/10; B08B 3/10

[52] U.S. Cl. ..... 239/578; 239/281; 239/579; 239/583; 239/172; 248/277; 134/172; 222/174

[58] Field of Search ..... 239/281, 172, 578, 579, 239/583, 67, 587; 248/277; 134/167 R, 172, 174, 168 R; 251/58, 294; 222/174, 141; 118/317

[56] References Cited

U.S. PATENT DOCUMENTS

| | | | |
|---|---|---|---|
| 1,419,686 | 6/1922 | Nicholson | 239/578 |
| 1,554,746 | 9/1925 | Meinel | 248/277 |
| 2,147,292 | 2/1939 | Hachmuth | 239/578 |
| 3,017,056 | 1/1962 | Bishop | 239/579 |
| 3,212,511 | 10/1965 | Cuillier | 134/107 |
| 3,291,144 | 12/1966 | Diamond | 134/104.1 |
| 3,901,255 | 8/1975 | Pettit | 134/171 |
| 4,092,996 | 6/1978 | Kock | 239/281 |
| 4,242,311 | 12/1980 | Middaugh | 134/172 |
| 4,722,460 | 2/1988 | Madsen | 239/578 |

FOREIGN PATENT DOCUMENTS 247699 9/1969 U.S.S.R. .

*Primary Examiner*—Andres Kashnikow
*Assistant Examiner*—Christopher G. Trainor
*Attorney, Agent, or Firm*—Birch, Stewart, Kolasch & Birch

[57] ABSTRACT

The present invention relates to a sanitary chemical spray apparatus mounted to a front bumper of a dump truck, which comprises an extensible jack member and a spray gun including a guide roller and a plurality of nozzles disposed at one end thereof for inserting into a trash container through a door or disposed at the front upper portion of a side wall thereof. The nozzles of the apparatus can be used to spray chemicals within the trash container after removing the solid waste materials therefrom during a sanitary cleaning operation.

8 Claims, 3 Drawing Sheets

FIG. 1
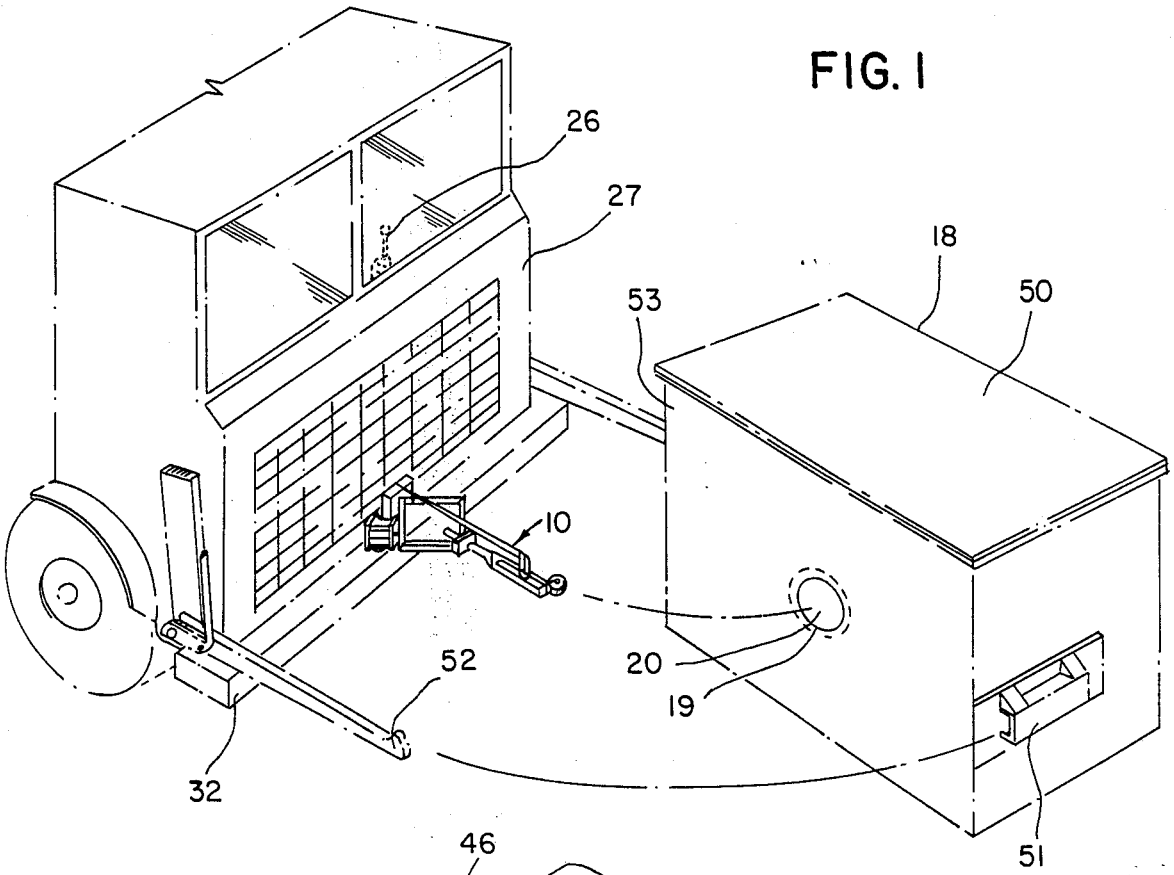
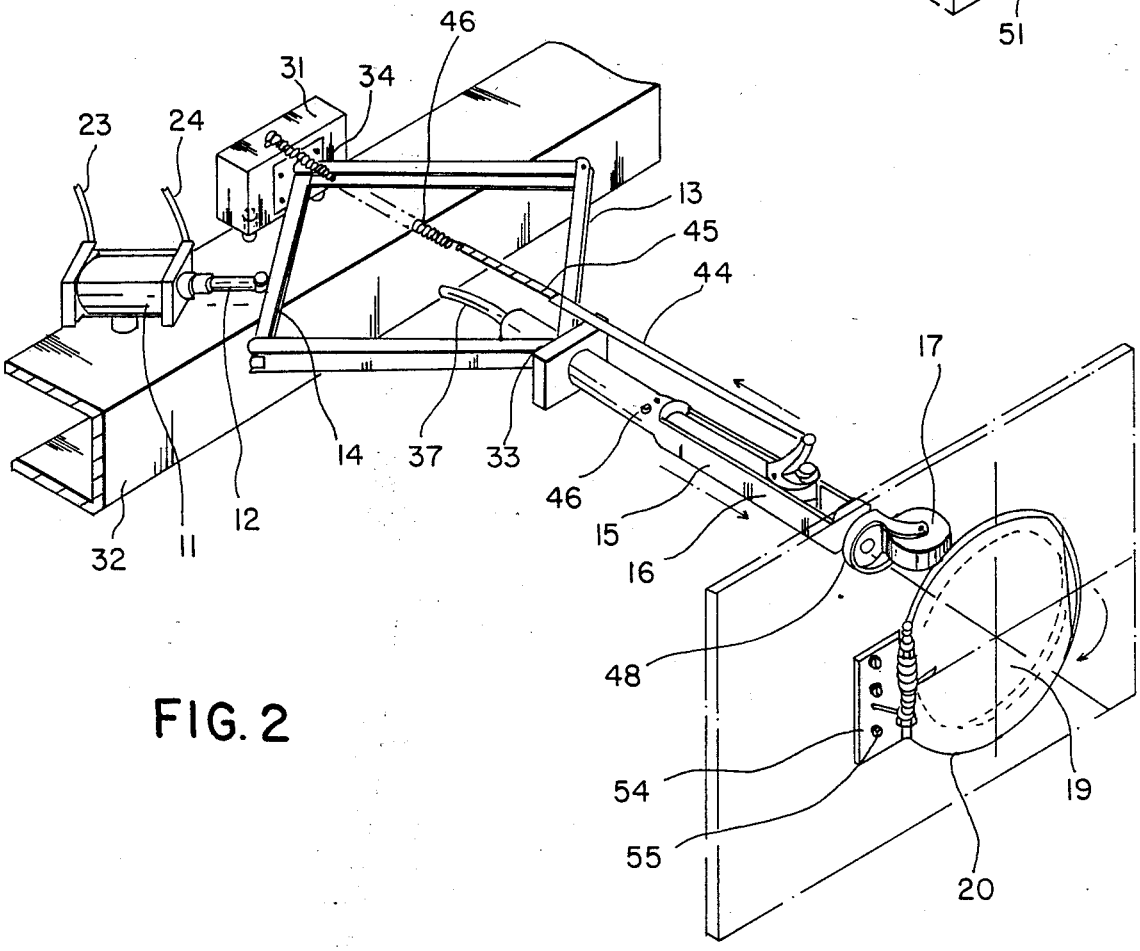
FIG. 2

SANITARY CHEMICAL SPRAY APPARATUS

BACKGROUND OF THE INVENTION

1. Field of the Invention

The present invention relates to a sanitary chemical spray apparatus and more particularly to a chemical spray apparatus mounted to a front bumper of a dump truck, which is provided with an extensible jack member having a nozzle disposed at an end portion thereof for spraying chemicals into the interior of a trash container through a door disposed at the font upper portion of a side wall thereof after solid waste materials have been removed from the dump truck during a sanitary cleaning operation.

2. Description of the Prior Art

It is conventional practice in the prior art to use a chemical spray device for spraying chemicals into the inside of a trash container through a top door thereof after removing solid waste materials therefrom during the dumping of the trash container. However, since such spray device contains a connecting member which has a fixed length which extends from the device to the nozzle thereof, the spray device cannot be adapted to operate with all size trash containers. Also, in the prior art devices, since the chemical liquid is sprayed from the outside into the trash container the liquid tends to run and leak from the trash container.

SUMMARY OF THE INVENTION

Accordingly, it is an object of the present invention to provide an improved sanitary chemical spray apparatus which is mounted to the front bumper of a dump truck.

Another object of the present invention is to provide a sanitary chemical spray apparatus which is structured for disinfecting a trash container by spraying the interior thereof with chemical liquid using a plurality of nozzles disposed at an end portion of a jack member. The jack member is inserted into the trash container through a door disposed at the front upper portion of a side wall thereof which faces the dump truck.

A further object of the present invention is to provide a sanitary chemical spray apparatus which is provided with an extensible jack member for adjusting the nozzle member within the trash container to effectively disinfect and sanitize all the interior walls of the container.

Still another object of the present invention is to provide a chemical spray apparatus which is provided with a guide roller disposed at an end portion of the spray gun, which slidably pushes the door of the trash container open for inserting the spray member into the trash container.

Yet another object of the present invention is to provide a spray apparatus which is provided with a changeable nozzle member which can be adjusted to correspond to the size of the trash container.

Still a further object of the present invention is to spray the inside of a trash container through an aperture in the side of the container while the container is in a raised position, immediately after the trash has been discarded.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to a sanitary chemical spray apparatus mounted to a front bumper of a dump truck, which comprises a extensible jack member and a spray gun including a guide roller and a plurality of nozzles disposed at an end thereof for inserting the spray apparatus into a trash container through a door disposed at the front upper portion of a side wall thereof. The container is sprayed after removing the solid waste materials therefrom during a sanitary cleaning operation.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a perspective view showing how the sanitary chemical spray apparatus of the present invention can be utilized with a trash container;

FIG. 2 is a perspective view showing the sanitary chemical spray apparatus containing the door of the trash container to begin the disinfecting operation;

DETAILED DESCRIPTION OF THE INVENTION

Figure 3:
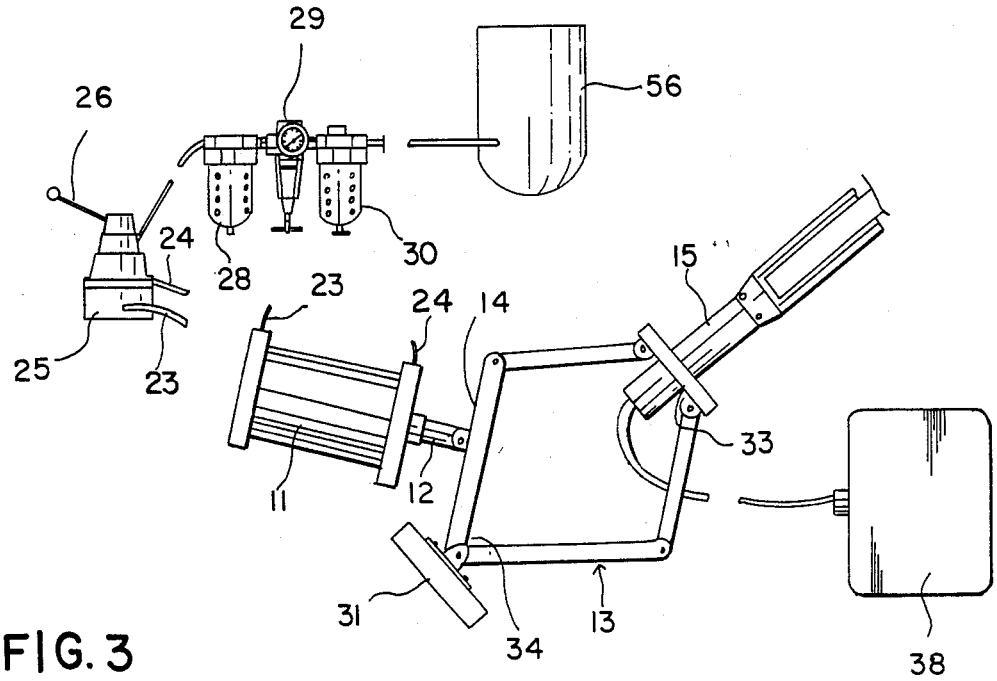
FIG. 3 diagrammatically shows the mechanical system of the present invention.
Figure 5:
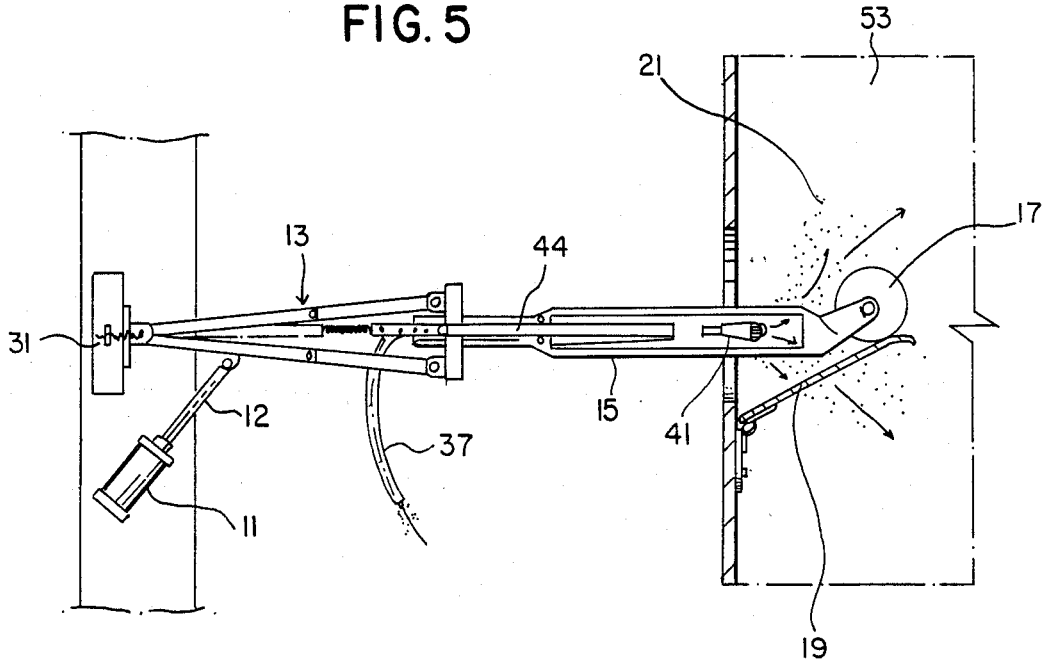
FIG. 5 is a top view showing how the sanitary chemical spray device is inserted into the trash container.

Referring now in detail to the drawings for the purpose of illustrating the present invention, the sanitary chemical spray apparatus 10 as shown in Figs. 1, 2 and 3 comprises a cylinder 11 containing a piston 12, an extensible square shaped jack member 13 containing a jack rod 14 connected to the piston 12, a gun member 15 connected to a corner 33 of the extensible square shaped jack member 13, and a sprayer 16 disposed in the gun member 15. A guide roller 17 is connected to one end portion of the gun member 15 for guiding the gun member 15 into a trash container 18 through an aperture 19 and a door 20. The gun member 15 is used to disinfect and sterilize the interior of the trash container 20 by spraying chemicals 21 through a plurality of nozzles 22 disposed at one end of the sprayer 16 (FIG. 5).

The cylinder 11 is provided with a first air hose 23 and a second air hose 24 and the first and second air hoses 23 and 24 are connected to a control member 25 having a handle 26 which is attached to the dashboard of the dump truck 27 (FIG. 3). The control member 25 is connected to an oil storage reservoir 28, a pressure gauge 29 and to an air storage reservoir 30 which connects to an air tank 56 disposed in the dump truck 27. Thus, the piston 12 in the cylinder 11 can be moved in the forward and backward direction by introducing air through the first and second hoses 23 and 24 when the handle 26 attached to the control member 25 is manually actuated.

Figure 6:
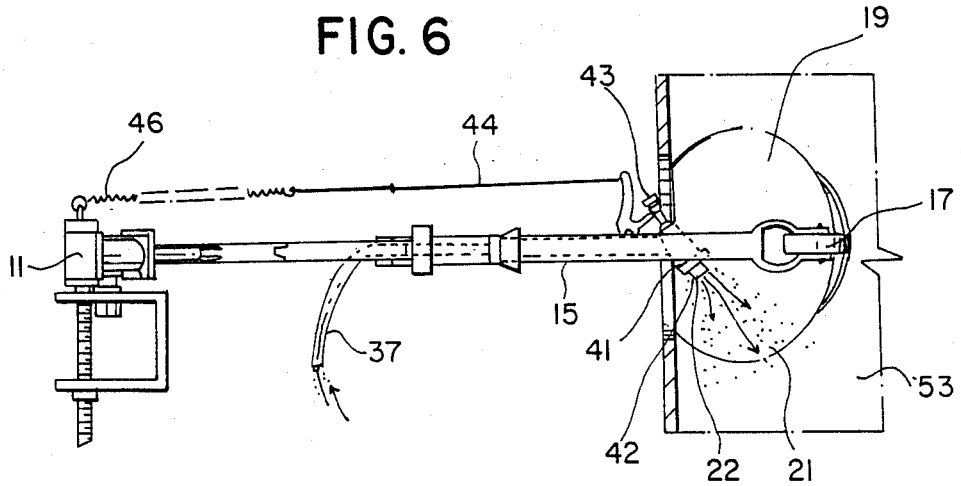
FIG. 6 is a side view showing how the sanitary chemical spray device is inserted into the trash container.
Figure 7:
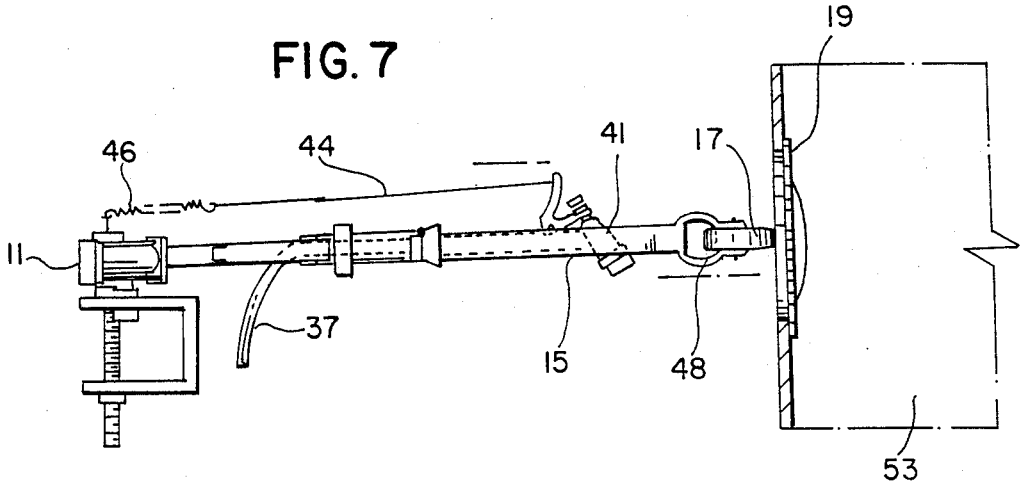
FIG. 7 is side view showing how the sanitary chemical spray device is removed from the trash container.

One corner 34 of the extensible square shaped jack member 13 is attached to a jack plate 31 mounted to the front bumper 32 of the dump truck 27. When the piston 12 moves backward the jack member 13 has a square configuration (FIGS. 2 and 7). However, when the piston 12 moves in the forward direction, the jack member 13 is extended to show a straight line configuration (FIGS. 5 and 6). At this time, the gun member 15 is inserted into the trash container 18 through the aperture 19 and door 20. The piston 12 is attached to the jack rod 14 which, in turn, one end is secured to the jack plate 31.

Figure 4:
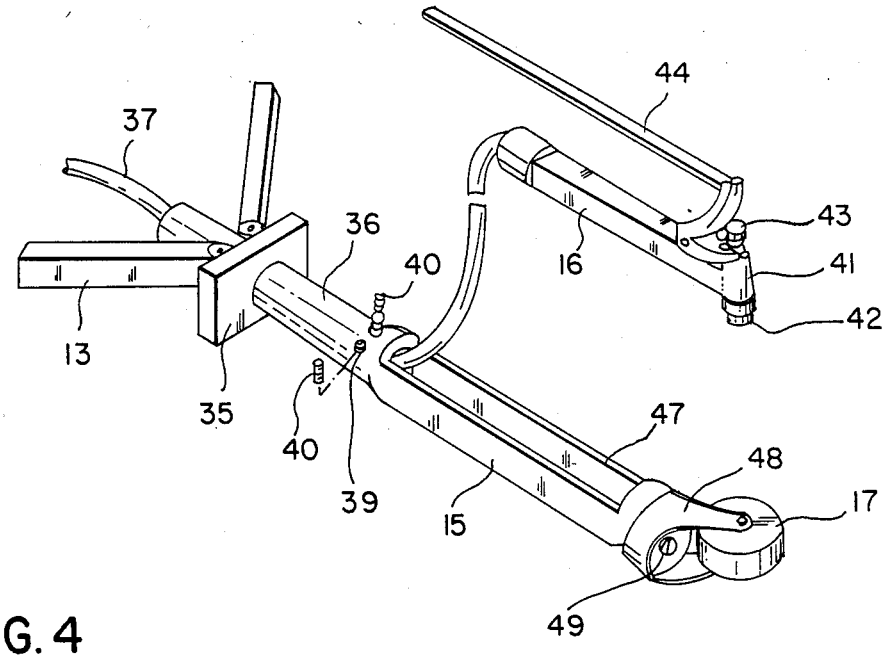
FIG. 4 is a perspective view of the spray gun showing a spray member separated therefrom.

As shown in FIG. 4, gun member 15 connected to the corner 33 of the extensible square shaped jack member 13 through a plate 35 includes a tubular body 36 disposed at the other end thereof which is connected to a chemical hose 37 which, in turn, is connected to a chemical tank 38 (FIG. 3). The tubular body 36 contains adjustable screw holes 39 and bolts 40 for adjusting the location of the sprayer 16. The sprayer 16 includes a nozzle adapter 41 disposed at one end thereof. The nozzle adapter 41 contains a nozzle body 42 having the plurality of nozzles 22 which are disposed at one end thereof (FIGS. 5 and 6). An on/off switch 43 disposed at the other end of the nozzle adapter 41 connects to one "L" shaped end of a rod 44. The other end of the rod 44 contains a plurality of adjusting holes 45 which are connected to a spring 46 and for selectively adjusting the extensible power of the spring 46 (FIG. 2).

A roller housing 48 containing a guide roller 17 is connected to an open end 47 of the gun member 15 through a bolt 49. The guide roller 17 can be periodically changed as necessary. The trash container 18 comprises a top lid 50, handle members 51 for engaging with hooks 52 mounted to the dump truck 27, and the door 20 attached to the interior of a front side wall 53 through a hinge member 54 and bolts 55 (FIG. 2). The door contains a bent portion for easily inserting the gun member 15 into the trash container 18 or for slidably returning the gun member 15 from the trash container 18.

In the operation, when the dump truck 27 is positioned to face the front side wall 53 of the trash container 18, the hooks 52 of the dump truck engages to the handles 51 of the trash container and the guide roller 17 of the chemical spray apparatus 10 of the present is extended to touch to the door 20 of the trash container (FIGS. 2 and 7). After the solid waste material is removed from the trash container 18, in the conventional method, i.e., the trash container 18 is lifted over the dump truck 27, by actuating the handle 26 disposed on the dashboard, the piston 12 pushes to the extensible square shaped jack member 13 to extend it to a straight line configuration. In this time, the gun member 15 is inserted into the inside of the trash container 18 and simultaneously the spring 46 pulls the rod 44 to actuate the opening of the on/off switch 43 (FIGS. 5 and 6). Thus, the on/off switch is opened and the chemicals are sprayed around the inside of the empty trash container 18, specially at the bottom thereof immediately after the trash has been discarded from the trash container. Accordingly, the disinfection and sterilization is achieved very well and uniformly.

When the operation is accomplished, by actuating the handle 26, the piston 12 returns to its original position for converting the jack member 13 to its initial square shaped configuration. Simultaneously the spring 46 releases to close the on/off switch 43 which stops the chemical spray operation (FIG. 7).

The sanitary chemical spray apparatus of the present invention has many features including the equipment of dump trucks with a compact spray apparatus; adjusting the location of the sprayer by utilizing bolts 40 and apertures 39; adjusting the tension of the spring 46 using the adjusting holes 45; and replacing the guide roller 17 utilizing bolts 49.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A. sanitary chemical spray apparatus which comprises:

a spray gun member containing a spray nozzle device disposed at one end thereof, a jack member containing a piston and cylinder, connected to the other end of said spray gun member, said piston and cylinder being operable to extend and retract said jack member and the spray gun member attached thereto, and an on/off switch operatively connected with said spray gun member, said on/off switch being connected to a rod member which is mounted to automatically open the on/off switch when the jack member is extended and automatically close the on/off switch when the jack member is retracted.

2. The sanitary chemical spray apparatus of claim 1 wherein the rod member is connected to a spring member which opens and closes the on/off switch in accordance with the bias of the spring member as the jack member is extended and retracted.

3. The sanitary chemical spray apparatus of claim 1 wherein the jack member is provided means for changing the bias of the spring.

4. The sanitary chemical spray apparatus of claim 1 wherein a roller means is operatively associated with said one end of the spray gun member.

5. The sanitary chemical spray apparatus of claim 1 wherein the cylinder is provided with first and second air hoses which are connected to front and back portions of the cylinder for introducing air to both sides of the cylinder for moving the piston in the forward and backward direction.

6. The sanitary chemical spray apparatus of claim 1 wherein the jack member has a substantially square configuration when in a retracted state and a straight line configuration when in an extended state.

7. The sanitary chemical spray apparatus of claim 6 wherein the spray gun member contains a hose member disposed therein for supplying chemicals to the spray gun member from a chemical tank.

8. The sanitary chemical spray apparatus of claim 1 wherein a guide roller is provided with a roller housing attached to said one end of the spray gun member.

* * * * *